US009724909B2

(12) United States Patent
Moorlag et al.

(10) Patent No.: US 9,724,909 B2
(45) Date of Patent: Aug. 8, 2017

(54) METHODS FOR INK-BASED DIGITAL PRINTING WITH HIGH INK TRANSFER EFFICIENCY

(71) Applicant: XEROX CORPORATION, Norwalk, CT (US)

(72) Inventors: Carolyn Moorlag, Mississauga (CA); Marcel Breton, Mississauga (CA); Guerino Sacripante, Oakville (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 14/139,690

(22) Filed: Dec. 23, 2013

(65) Prior Publication Data

US 2015/0174887 A1 Jun. 25, 2015

(51) Int. Cl.

| | |
|---|---|
| ***B41F 7/24*** | (2006.01) |
| ***B41F 31/02*** | (2006.01) |
| ***B41F 31/20*** | (2006.01) |
| ***B41F 7/02*** | (2006.01) |
| ***B41F 7/26*** | (2006.01) |

(52) U.S. Cl.

CPC ..... *B41F 7/24* (2013.01); *B41F 7/02* (2013.01); *B41F 7/26* (2013.01); *B41F 31/02* (2013.01); *B41F 31/20* (2013.01); *B41P 2227/70* (2013.01)

(58) Field of Classification Search

CPC ... B41F 7/24; B41F 31/18; B41F 7/02; B41N 3/08; B41P 2227/70

See application file for complete search history.

(56) References Cited

U.S. PATENT DOCUMENTS

| | | | |
|---|---|---|---|
| 3,945,957 | A | 3/1976 | Noshiro et al. |
| 4,304,601 | A | 12/1981 | Sharp |
| 4,403,550 | A | 9/1983 | Sharp |
| 4,445,432 | A | 5/1984 | Ford, Jr. et al. |
| 4,806,391 | A | 2/1989 | Shorin |
| 4,911,999 | A | 3/1990 | Legere |
| 4,927,180 | A | 5/1990 | Trundle et al. |
| 5,085,698 | A | 2/1992 | Ma et al. |

(Continued)

FOREIGN PATENT DOCUMENTS

| | | | |
|---|---|---|---|
| EP | 1235863 | B1 | 1/2005 |
| JP | 03069954 | A | 8/1989 |

(Continued)

OTHER PUBLICATIONS

Communication dated May 4, 2015 issued in European Patent Application No. 14196839.6, pp. 1-5.

(Continued)

*Primary Examiner* — Jennifer Simmons

(74) *Attorney, Agent, or Firm* — MH2 Technology Law Group LLP

(57) ABSTRACT

A method for ink-based digital printing includes applying a uniform layer of dampening fluid to a surface of an imaging member; laser patterning the dampening fluid layer by selectively removing portions of the dampening fluid according to digital image data; and inking the laser-patterned dampening fluid layer on the imaging member surface with a aqueous heterogeneous ink to form an ink image, wherein the aqueous heterogeneous ink self-coalesces before the ink is transferred from the imaging member surface.

7 Claims, 2 Drawing Sheets

(56) References Cited

U.S. PATENT DOCUMENTS 5,502,476 A 3/1996 Neal et al.
5,834,118 A 11/1998 Ranby et al.
5,886,067 A 3/1999 Li et al.
6,114,489 A 9/2000 Vicari et al.
6,329,446 B1 12/2001 Sacripante et al.
6,348,561 B1 * 2/2002 Mychajlowskij .. C08G 63/6886 528/274
6,664,015 B1 12/2003 Sacripante
6,896,937 B2 5/2005 Woudenberg
7,022,752 B2 4/2006 Hayashi et al.
7,151,153 B2 12/2006 Bruchmann et al.
7,202,006 B2 4/2007 Chopra et al.
7,208,258 B2 4/2007 Gervasi et al.
7,322,688 B2 1/2008 Woudenberg
7,538,070 B2 5/2009 Iftime et al.
7,556,844 B2 7/2009 Iftime et al.
7,674,326 B2 3/2010 Iftime et al.
7,708,396 B2 5/2010 Iftime et al.
7,718,325 B2 5/2010 Norsten et al.
7,723,398 B2 5/2010 Ilg et al.
7,909,924 B2 3/2011 Krishnan et al.
7,964,271 B2 6/2011 Norsten et al.
8,001,889 B2 8/2011 Gaugenrieder et al.
8,124,791 B2 2/2012 Shinjo et al.
8,158,693 B2 4/2012 Breton et al.
8,222,313 B2 7/2012 Iftime et al.
8,771,787 B2 7/2014 Breton et al.
8,895,400 B2 11/2014 Seo et al.
9,011,594 B1 4/2015 Kanungo et al.
9,193,209 B2 11/2015 Dooley et al.
9,283,795 B1 3/2016 Kanungo et al.
9,359,512 B2 6/2016 Moorlag et al.
9,387,661 B2 7/2016 Zirilli
2002/0040073 A1 4/2002 Stone et al.
2002/0107303 A1 8/2002 Miyabashi et al.
2003/0003323 A1 1/2003 Murakami et al.
2003/0021961 A1 1/2003 Ylitalo et al.
2003/0044691 A1 3/2003 Setthachayanon et al.
2003/0073762 A1 4/2003 Jung et al.
2003/0149130 A1 8/2003 Kondo
2004/0063809 A1 4/2004 Fu et al.
2004/0132862 A1 7/2004 Woudenberg
2004/0233465 A1 11/2004 Coyle et al.
2005/0166783 A1 8/2005 Ylitalo et al.
2006/0054040 A1 3/2006 Daems et al.
2007/0073762 A1 3/2007 Adamson et al.
2007/0166479 A1 7/2007 Drake et al.
2007/0259986 A1 11/2007 Elwakil et al.
2008/0090929 A1 4/2008 Wilson et al.
2008/0139743 A1 6/2008 Krishnan et al.
2008/0241485 A1 10/2008 Shimohara et al.
2008/0258345 A1 10/2008 Bens et al.
2008/0317957 A1 12/2008 Overbeek et al.
2009/0038506 A1 2/2009 Odell et al.
2009/0104373 A1 4/2009 Vanbesien et al.
2009/0110843 A1 4/2009 Halahmi et al.
2009/0135239 A1 5/2009 Chretien et al.
2009/0280302 A1 11/2009 Fukumoto et al.
2010/0020123 A1 1/2010 Hirato
2010/0067056 A1 3/2010 Rich et al.
2010/0214373 A1 8/2010 Carr et al.
2010/0239777 A1 9/2010 Nakajima et al.
2011/0045199 A1 2/2011 Cong
2011/0141187 A1 6/2011 Takabayashi
2011/0188023 A1 * 8/2011 Rondon ..... B41C 1/1016 355/77
2011/0196058 A1 8/2011 Breton et al.
2011/0262711 A1 10/2011 Chopra et al.
2012/0040156 A1 2/2012 Ohashi et al.
2012/0103212 A1 5/2012 Stowe et al.
2012/0103213 A1 * 5/2012 Stowe ..... B41C 1/1033 101/148
2012/0103218 A1 5/2012 Stowe et al.
2012/0103221 A1 5/2012 Stowe et al.
2013/0050366 A1 2/2013 Sasada et al.
2013/0104756 A1 5/2013 Stowe et al.
2013/0305946 A1 11/2013 Iftime et al.
2013/0305947 A1 11/2013 Iftime et al.
2013/0307913 A1 11/2013 Kawashima et al.
2013/0310479 A1 11/2013 Lee et al.
2013/0310517 A1 11/2013 Lee et al.
2013/0324653 A1 12/2013 Bollard et al.
2014/0235752 A1 * 8/2014 Gharapetian ..... C09D 133/00 523/201
2014/0333704 A1 11/2014 Takabayashi et al.
2014/0340455 A1 11/2014 Breton et al.
2015/0077501 A1 3/2015 Breton et al.
2015/0093690 A1 4/2015 Shimura et al.
2015/0170498 A1 6/2015 Beggs et al.
2015/0175820 A1 6/2015 Breton et al.
2015/0175821 A1 6/2015 Moorlag et al.
2016/0090490 A1 3/2016 Moorlag et al.
2016/0176185 A1 6/2016 Kanungo et al.
2016/0177113 A1 6/2016 Allen et al.
2016/0222231 A1 8/2016 Allen et al.
2016/0237290 A1 8/2016 Moorlag et al.
2016/0257829 A1 9/2016 Breton et al.
2016/0264798 A1 9/2016 Allen et al.
2016/0333205 A1 11/2016 Lee et al.

FOREIGN PATENT DOCUMENTS

JP 2011208019 A 10/2011
WO 2013119539 A1 8/2013

OTHER PUBLICATIONS

Badesha, et al. "Fluorosilicone composite and Formulation Process for Imaging Plate", U.S. Appl. No. 15/222,364, filed Jul. 28, 2016.
Henri Bouas-Laurent, et al., Organic Photochromism (IUPAC Technical Report), Pure Appl. Chem., vol. 73, No. 4, pp. 639-665, 2001.
Leach, et al., "The Printing Ink Manual, 5th Edition", Blue Print, New York, pp. 84-86, 516, 525, 544-550, 724-726 (1993).
Thesis of Enrique Michel-Sanchez, Impact of Particle Morphology on the Rheology of PCC-Based Coatings, Aug. 2005.
Stowe, et al., "Methods for Rejuvenating an Imaging Member of an Ink-Based Digital Printing System", U.S. Appl. No. 15/240,691, filed Aug. 18, 2016.
Birau, et al. "Ink Composition and Method of Printing", U.S. Appl. No. 15/377,881, filed Dec. 13, 2016.

* cited by examiner

METHODS FOR INK-BASED DIGITAL PRINTING WITH HIGH INK TRANSFER EFFICIENCY

RELATED APPLICATIONS

This application relates to U.S. patent application Ser. No. 14/139,708 filed Dec. 23, 2013 (allowed); and U.S. patent application Ser. No. 14/139,811 filed Dec. 23, 2013 (now U.S. Pat. No. 9,359,512 issued Jun. 7, 2016.), the disclosures of which are hereby incorporated by reference herein in their entireties.

FIELD OF DISCLOSURE

The disclosure relates to ink-based digital printing methods. In particular, the disclosure relates to methods for transferring an ink image using a film-forming aqueous ink that is partially coalesced and transferred to a substrate before a fully coalesced film forms.

BACKGROUND

Digital offset lithography printing systems require-offset type inks that are specifically designed and optimized to be compatible with the various subsystems, including an ink delivery system and a laser imaging system, to enable high quality printing at high speed. Traditionally, offset ink used required ink rheology that enabled the ink to split from the offset plate. Poor transfer during ink based digital printing results in imaging defects, however, and increases system and operating costs because the imaging member surface must be clean before each printing cycle begins.

SUMMARY

A challenging and desirable feature for ink based digital printing or digital offset lithography printing is 100% transfer of ink from the imaging plate on which dampening fluid patterning and ink image formation occurs. Methods for ink based digital printing are provided that enable greater than 50% and preferably 90% to 100% transfer of ink from an imaging member such as an imaging plate to a printable substrate such as paper, metal, plastic, or other suitable printable substrates. In particular, methods for ink based digital printing in accordance with embodiments include inking an imaging member using ink that partially coalesces during a period of time between inking and transfer of the ink to a printable substrate.

Exemplary embodiments are described herein. It is envisioned, however, that any system that incorporates features of systems described herein are encompassed by the scope and spirit of the exemplary embodiments.

DETAILED DESCRIPTION

Figure 1:
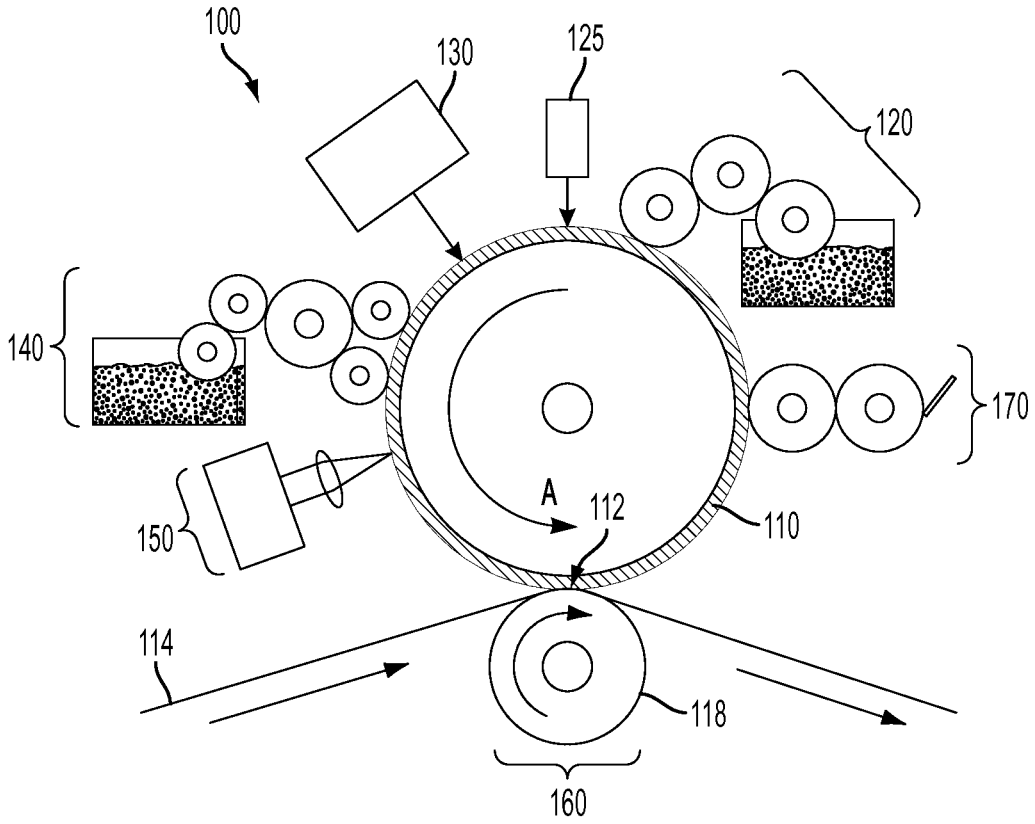
FIG. 1 RELATED ART
FIG. 1 shows a side diagrammatical view of a related art ink-based digital printing system.

Exemplary embodiments are intended to cover all alternatives, modifications, and equivalents as may be included within the spirit and scope of the apparatus and systems as described herein.

The modifier "about" used in connection with a quantity is inclusive of the stated value and has the meaning dictated by the context (for example, it includes at least the degree of error associated with the measurement of the particular quantity). When used with a specific value, it should also be considered as disclosing that value.

Reference is made to the drawings to accommodate understanding of systems for ink-based digital printing using an aqueous polymer heterogeneous ink that partially coalesces during a period of time between inking on an imaging member and transfer of the ink to another member such as a printable substrate. In the drawings, like reference numerals are used throughout to designate similar or identical elements.

Ink-based digital printing or variable data lithographic printing systems are discussed. Ink-based digital printing systems are useful for printing using methods in accordance with embodiments.

"Variable data lithography printing," or "ink-based digital printing," or "digital offset printing" is lithographic printing of variable image data for producing images on a substrate that are changeable with each subsequent rendering of an image on the substrate in an image forming process. "Variable data lithographic printing" includes offset printing of ink images using lithographic ink wherein the images are based on digital image data that may vary from image to image. Ink-based digital printing uses a variable data lithography printing system, or digital offset printing system. A "variable data lithography system" is a system that is configured for lithographic printing using lithographic inks and based on digital image data, which may be variable from one image to the next.

Such systems are disclosed in U.S. patent application Ser. No. 13/095,714 ("714 Application"), titled "Variable Data Lithography System," filed on Apr. 27, 2011, by Stowe et al., the disclosure of which is hereby incorporated by reference herein in its entirety. The systems and methods disclosed in the 714 Application are directed to improvements on various aspects of previously-attempted variable data imaging lithographic marking concepts based on variable patterning of dampening fluids to achieve effective truly variable digital data lithographic printing.

The 714 Application describes an exemplary variable data lithography system 100 for ink-based digital printing, such as that shown, for example, in FIG. 1. A general description of the exemplary system 100 shown in FIG. 1 is provided here. Additional details regarding individual components and/or subsystems shown in the exemplary system 100 of FIG. 1 may be found in the 714 Application.

As shown in FIG. 1, the exemplary system 100 may include an imaging member 110. The imaging member 110 in the embodiment shown in FIG. 1 is a drum, but this exemplary depiction should not be interpreted so as to exclude embodiments wherein the imaging member 110 includes a drum, plate or a belt, or another now known or later developed configuration. The reimageable surface may be formed of materials including, for example, silicones, including polydimethylsiloxane (PDMS), among others. The reimageable surface may be formed of a relatively thin layer over a mounting layer, a thickness of the relatively thin layer being selected to balance printing or marking performance, durability and manufacturability.

The imaging member 110 is used to apply an ink image to an image receiving media substrate 114 at a transfer nip 112. The transfer nip 112 is formed by an impression roller 118, as part of an image transfer mechanism 160, exerting pressure in the direction of the imaging member 110. Image receiving medium substrate 114 should not be considered to be limited to any particular composition such as, for example, paper, plastic, or composite sheet film. The exemplary system 100 may be used for producing images on a wide variety of image receiving media substrates. The 714 Application also explains the wide latitude of marking (printing) materials that may be used, including marking materials with pigment densities greater than 10% by weight. As does the 714 Application, this disclosure will use the term ink to refer to a broad range of printing or marking materials to include those which are commonly understood to be inks, pigments, and other materials which may be applied by the exemplary system 100 to produce an output image on the image receiving media substrate 114.

The 714 Application depicts and describes details of the imaging member 110 including the imaging member 110 being comprised of a reimageable surface layer formed over a structural mounting layer that may be, for example, a cylindrical core, or one or more structural layers over a cylindrical core.

The system 100 includes a dampening fluid system 120 generally comprising a series of rollers, which may be considered as dampening rollers or a dampening unit, for uniformly wetting the reimageable surface of the imaging member 110 with dampening fluid. A purpose of the dampening fluid system 120 is to deliver a layer of dampening fluid, generally having a uniform and controlled thickness, to the reimageable surface of the imaging member 110. As indicated above, it is known that a dampening fluid such as fountain solution may comprise mainly water optionally with small amounts of isopropyl alcohol or ethanol added to reduce surface tension as well as to lower evaporation energy necessary to support subsequent laser patterning, as will be described in greater detail below. For inks and methods of embodiments, however, suitable dampening fluids contain substantially no water, which is immiscible with the inks used in methods of embodiments. Other suitable dampening fluids contain no greater than 10 percent water by weight. Generally, suitable dampening fluid is a low-surface tension fluid that is not miscible with water contained in the ink. Small amounts of certain surfactants may be added to the fountain solution as well.

Once the dampening fluid is metered onto the reimageable surface of the imaging member 110, a thickness of the dampening fluid may be measured using a sensor 125 that may provide feedback to control the metering of the dampening fluid onto the reimageable surface of the imaging member 110 by the dampening fluid system 120.

After a precise and uniform amount of dampening fluid is provided by the dampening fluid system 120 on the reimageable surface of the imaging member 110, and optical patterning subsystem 130 may be used to selectively form a latent image in the uniform dampening fluid layer by imagewise patterning the dampening fluid layer using, for example, laser energy. Typically, the dampening fluid will not absorb the optical energy (IR or visible) efficiently. The reimageable surface of the imaging member 110 should ideally absorb most of the laser energy (visible or invisible such as IR) emitted from the optical patterning subsystem 130 close to the surface to minimize energy wasted in heating the dampening fluid and to minimize lateral spreading of heat in order to maintain a high spatial resolution capability. Alternatively, an appropriate radiation sensitive component may be added to the dampening fluid to aid in the absorption of the incident radiant laser energy. While the optical patterning subsystem 130 is described above as being a laser emitter, it should be understood that a variety of different systems may be used to deliver the optical energy to pattern the dampening fluid.

The mechanics at work in the patterning process undertaken by the optical patterning subsystem 130 of the exemplary system 100 are described in detail with reference to the 714 Application's FIG. 5. Briefly, the application of optical patterning energy from the optical patterning subsystem 130 results in selective removal of portions of the layer of dampening fluid.

Following patterning of the dampening fluid layer by the optical patterning subsystem 130, the patterned layer over the reimageable surface of the imaging member 110 is presented to an inker subsystem 140. The inker subsystem 140 is used to apply a uniform layer of ink over the layer of dampening fluid and the reimageable surface layer of the imaging member 110. The inker subsystem 140 may use an anilox roller to meter an offset lithographic ink onto one or more ink forming rollers that are in contact with the reimageable surface layer of the imaging member 110. Separately, the inker subsystem 140 may include other traditional elements such as a series of metering rollers to provide a precise feed rate of ink to the reimageable surface. The inker subsystem 140 may deposit the ink to the pockets representing the imaged portions of the reimageable surface, while ink on the unformatted portions of the dampening fluid will not adhere to those portions.

The cohesiveness and viscosity of the ink residing on the reimageable layer of the imaging member 110 may be modified by using a rheology (complex viscoelastic modulus) control subsystem 150. In particular, the ink may be optional dried or heated to partially coalesce the ink using the rheological conditioning system, which may be configured for applying heat to increase the ink's cohesive strength relative to the reimageable surface layer. Cooling may be used to modify rheology as well via multiple physical cooling mechanisms, as well as via chemical cooling.

The ink is then transferred from the reimageable surface of the imaging member 110 to a substrate of image receiving medium 114 using a transfer subsystem 160. The transfer occurs as the substrate 114 is passed through a nip 112 between the imaging member 110 and an impression roller 118 such that the ink within the voids of the reimageable surface of the imaging member 110 is brought into physical contact with the substrate 114. Optional modification of the adhesion of the ink using rheology control system 150 enhances the ability of the ink to adhere to the substrate 114 and to separate from the reimageable surface of the imaging member 110. Careful control of the temperature and pressure conditions at the transfer nip 112 may allow transfer efficiencies for the ink from the reimageable surface of the imaging member 110 to the substrate 114 to exceed 95%. While it is possible that some dampening fluid may also wet substrate 114, the volume of such a dampening fluid will be minimal, and will rapidly evaporate or be absorbed by the substrate 114.

In certain offset lithographic systems, it should be recognized that an offset roller, not shown in FIG. 1, may first receive the ink image pattern and then transfer the ink image pattern to a substrate according to a known indirect transfer method.

Following the transfer of the majority of the ink to the substrate 114, any residual ink and/or residual dampening fluid must be removed from the reimageable surface of the imaging member 110, preferably without scraping or wearing that surface. An air knife may be employed to remove residual dampening fluid. It is anticipated, however, that some amount of ink residue may remain. Removal of such remaining ink residue may be accomplished through use of some form of cleaning subsystem 170.

The 714 Application describes details of such a cleaning subsystem 170 including at least a first cleaning member such as a sticky or tacky member in physical contact with the reimageable surface of the imaging member 110, the sticky or tacky member removing residual ink and any remaining small amounts of surfactant compounds from the dampening fluid of the reimageable surface of the imaging member 110. The sticky or tacky member may then be brought into contact with a smooth roller to which residual ink may be transferred from the sticky or tacky member, the ink being subsequently stripped from the smooth roller by, for example, a doctor blade.

The 714 Application details other mechanisms by which cleaning of the reimageable surface of the imaging member 110 may be facilitated. Regardless of the cleaning mechanism, however, cleaning of the residual ink and dampening fluid from the reimageable surface of the imaging member 110 is essential to preventing ghosting in the proposed system. Once cleaned, the reimageable surface of the imaging member 110 is again presented to the dampening fluid system 120 by which a fresh layer of dampening fluid is supplied to the reimageable surface of the imaging member 110, and the process is repeated.

The imaging member reimageable surface may comprise a polymeric elastomer, such as silicone rubber and/or fluorosilicone rubber. The term "silicone" is well understood in the art and refers to polyorganosiloxanes having a backbone formed from silicon and oxygen atoms and sidechains containing carbon and hydrogen atoms. For the purposes of this application, the term "silicone" should also be understood to exclude siloxanes that contain fluorine atoms, while the term "fluorosilicone" is used to cover the class of siloxanes that contain fluorine atoms. Other atoms may be present in the silicone rubber, for example nitrogen atoms in amine groups which are used to link siloxane chains together during crosslinking. The side chains of the polyorganosiloxane can also be alkyl or aryl.

In embodiments of provided methods, efficient transfer of ink from an imaging member is enabled by partial coalescence of a film-forming aqueous ink on the imaging member, followed by transfer to paper, before the fully coalesced film is formed. The partially coalesced ink of higher internal cohesion will transfer without splitting. In this way, 100% ink transfer is enabled. Methods include using a self-coalescing aqueous ink; a low adhesion, releasing imaging member surface material; and printing at a process speed that is determined based on a coalescing rate of the ink so that the system will transfer all ink without splitting or adhering to the plate.

Methods also include the assistance of rheological modification by partial coalescence by the application of heat, light radiation, or air flow before transfer of the ink in the system.

An aqueous dispersible polymer heterogeneous ink refers to an ink containing a minimum of 10 percent water content, and comprising self-coalescing nano polymeric particles that are less that 1 micron in size, or less than 500 nm, or less than 200 nm, or less than 20 nm or mixtures of nanoparticles forming bimodal or trimodal distributions over the same range. The polymeric portion is dispersed within the liquid vehicle, while not being solubilized, to form a heterogeneous phase.

The aqueous dispersible polymer heterogeneous ink contains a high solids content, where the amount of liquid ink vehicle is between 40 percent and 75 percent, by weight and comprising at least 10 percent water content. Other liquid vehicle components may comprise alcohols, glycols, pyrrolidone, and others, as are known to those skilled in the art.

The aqueous dispersible polymer heterogeneous ink may contain a total solids content as high as of 60 percent by weight, where the amount of polymeric particles is between about 10 percent to about 55 percent and the amount pigmented colorant is between about 5 percent to about 25 percent.

In one embodiment, the aqueous polymer heterogeneous ink may be an aqueous dispersible polymer ink, where the polymer content comprises self-aggregating and self-dispersing polymer particles in the absence of surfactant. Aqueous ink compositions are generally known. For example, Sacripante et. al. disclose certain aqueous ink compositions in U.S. Pat. No. 6,329,446, titled "INK COMPOSITION," issued Dec. 11, 2001.

In another embodiment, the aqueous polymer heterogeneous ink is a latex polymer ink, where the polymer content comprises polymerized particles stabilized with surfactant.

In another embodiment, the aqueous polymer heterogeneous ink is an emulsified polymer in aqueous solution, and wherein the size of the stable emulsion phase is less than 1 micron.

The size of the polymeric phase of the aqueous polymer heterogeneous ink is less than 1 micron, or less than 500 nm, or less than 200 nm, or less than 20 nm or mixtures of nanoparticles forming bimodal or trimodal distributions over the same range, and are therefore referred to as nanopolymeric particles. The nano-scale size of the polymeric particles enables fast and efficient partial coalescence of the ink during the printing process, as well as resulting in mechanical robustness of the printed image.

Rheological modification of the ink, taking place during partial coalescence between inking and transfer, drives the ability to transfer ink with greater than 90 percent transfer efficiency. The viscosity for aqueous inks that are delivered to the imaging surface covered in dampening fluid is in the range of between about 10 centipoise and about 10,000 centipoise, and corresponding approximately to a solids content of between 25% and 50% by weight. Following rheological modification, the viscosity for imaged aqueous inks that are transferred to a substrate is in the range of between about 10,000 centipoise and about 100,000,000 centipoise.

For methods in accordance with embodiments, a nanoparticle, dispersible polymer, water-based ink formulation was prepared and tested by hand testing with imaging member surfaces comprising fluorosilicone. A cyan pigmented ink was tested, which had properties as shown in the Table 1.

TABLE 1

Dispersible Polymer Ink Components

| ID 30941-87 | Mass of Pigment (g) dispersion | Mass of Resin (g) | Total Initial mass (Pig + Resin) (g) | Total Final mass (Pig + Resin) (g) | % pigment | % resin | % Solids |
|---|---|---|---|---|---|---|---|
| A | 100 | 15 | 115 | 117.62 | 14.45 | 12.75 | 27.21 |
| B | 100 | 20 | 120 | 118.25 | 14.38 | 16.91 | 31.29 |
| C | 100 | 25 | 125 | 118.70 | 14.32 | 21.06 | 35.38 |

TABLE 1-continued

| Dispersible Polymer Ink Components | | | | | | | |
|---|---|---|---|---|---|---|---|
| ID 30941-87 | Mass of Pigment (g) dispersion | Mass of Resin (g) | Total Initial mass (Pig + Resin) (g) | Total Final mass (Pig + Resin) (g) | % pigment | % resin | % Solids |
| D | 100 | 30 | 130 | 128.25 | 13.26 | 23.39 | 36.65 |
| E | 100 | 35 | 135 | 130.35 | 13.04 | 26.85 | 39.89 |

Solids loading for inks suitable for digital offset printing is higher compared with, for example, aqueous inks useful for inkjet applications. The ink base is a sulfonated polyester polymer resin that forms nano-sized particles in water. Ink formulations for exemplary inks useful for methods of embodiments are disclosed by, for example, U.S. application Ser. No. 14/139,708 filed Dec. 23, 2013 (now U.S. Pat. No. 9,644,105 issued May 9, 2017 and U.S. Pat. No. 14/139,811 filed Dec. 23, 2013 (now U.S. Pat. No. 9,359,512 issued Jun. 7, 2016.

Methods in accordance with embodiments were tested using inks in accordance with those shown in Table 1. For example, Inks A and E were tested for transfer from test fluorosilicone-containing imaging plates to paper. Ink A was used to demonstrate bench scale testing due to the slower rate of evaporation of this ink, whereas bench scale testing is necessarily slower than would be occurring within a print fixture.

Fluorosilicone plates used for testing were prepared from Nusil 3510 fluorosilicone in a ratio of 10:1 PartA:PartB (crosslinker). A fluorosilicone formulation was coated over silicone substrates and cured at 160° C. for 20 hours. Initial testing was performed by thinning inks A through E on a transparency, rolling onto a plate, then transferred by hand to paper. To determine a percent mass of transferred ink, a mass of plate and paper were determined. Ink was applied to the plate surface and hand transferred to paper. A mass of paper and the ink was determined. Also, a mass of the plate plus residual ink was determined. The percent mass was determined based on the following equation: % Mass=ink on plate/total ink.

This procedure was repeated for three transfers. The amount of ink on the test plate was not measurable (about 0.0 mg), and the amount of ink transferred to paper was consistently about 1.0 mg over a 20 $cm^2$ area. It was concluded that ink transfer was at least 90% by weight, but most of the plate surface area showed no cyan residue, indicating at or near 100% transfer in those areas.

By way of example, an ink containing surfactant, 2% Rodacal DS-10, was tested. The ink was in accordance with formulation A containing 10% diethylene glycol. Hand testing was carried out as described. 100% and at least 90% transfer was found, i.e., no ink residue was observed on the test plate. It was found that if the ink is applied in a thicker layer, e.g., greater than >1 mg (over 20 $cm^2$ area), then a slightly longer time between inking and transfer was required for very efficient transfer (~1 sec). In the case of ink layers of 1 micron or less, transfer could be carried out within 0.5 sec following inking. Transfer in a fixture could typically be carried out between 0.1 sec and 1.0 sec following the time of inking, and the transfer efficiency could be adjusted by an increase in the viscosity of the ink formulation at inking.

It was observed that efficient transfer is sensitive to drying of ink, and ink must not be fully dried on the plate before transfer occurs. Around the edges of an ink image, pattern, or droplet, ink tended to dry faster, resulting in adhesion to the plate. Bench testing is slow compared with desirable ink based digital printing process speeds of, for example, greater than 0.5 m/s. Inks B-E or inks having a higher viscosity are exemplary faster drying aqueous inks that are configured for faster coalescence under high speed printing conditions. High speed printing conditions would represent speeds of greater than 1 m/s, such as speeds between 2 m/s and 5 m/s.

Background is the condition of ink observed in the areas where dampening fluid is present, and where ink should not be observed. Background is considered to be good in cases where no ink is observed in areas of dampening fluid, and poor when inks are readily observed in non-inking areas. Background of dispersible polymer ink by D4 dampening fluid for tested inks was good.

The input of heat or air to speed drying time was not used for the demonstration. These inputs are used to control coalescence speed to match the printing system.

It was found that methods for ink based digital printing in accordance with embodiments enables greater than 85% and preferably 95% to 100% transfer of ink from an imaging member such as an imaging plate to a printable substrate such as paper, metal, plastic, or other suitable printable substrates. In some embodiments substantially no residue is left on the imaging member. In particular, methods for ink based digital printing include inking an imaging member using ink that partially coalesces between the inking and transfer of the ink to a printable substrate.

Ink viscosities for aqueous inks are lower than those typically used for offset printing, and help to enable delivery of inks from a roll system such as an anilox fixture onto the imaging surface.

Efficient ink transfer enables defect-free imaging. No cleaning subsystem is required, and system and operating costs are thus minimized. Inks useful for methods in accordance with embodiments cost less than fully curable inks or non-aqueous offset inks. No additional subsystem such as a UV cure station configured for curing the ink is necessary because the inks useful for methods of embodiments self-coalesce.

Further, methods in accordance with embodiments enable robust printing and longer print subsystem life expectancy due to higher incompatibility, and less opportunity for contamination, between water, dampening fluid, and imaging member materials. Allowing the ink to partially dry prior paper contact minimizes or eliminates many of the shortfalls of printing with conventional aqueous inks on paper, and requires less energy than, for example water evaporation techniques required for conventional aqueous inks.

Figure 2:
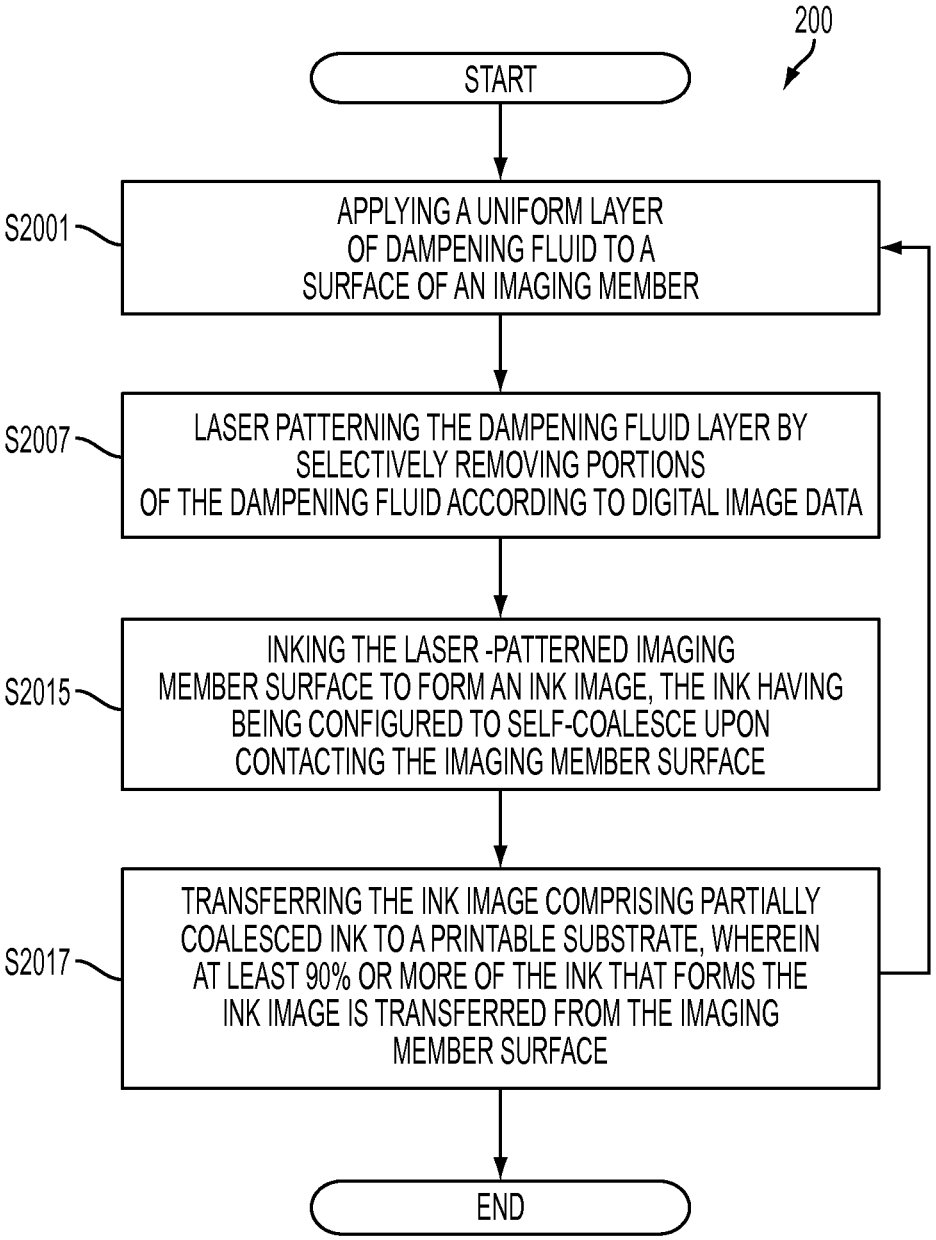
FIG. 2 shows methods of ink based digital printing in accordance with an exemplary embodiment.

FIG. 2 shows methods for ink based digital printing in accordance with an exemplary embodiment. In particular, FIG. 2 shows a method 200 for ink based digital printing using a dispersible polymer ink configured for self-coalescing upon application to an imaging member in ink based digital printing systems during a print process.

FIG. 2 shows that method 200 may include applying a uniform layer of dampening fluid to a surface of an imaging member at S2001. The imaging member may comprise a surface including fluorosilicone, for example. The dampening fluid may be D4 or D5, for example. The dampening fluid layer may preferably have a thickness of about 1 micron and/or less than 1 micron, and may be in the range of 200-500 nm.

Methods may include patterning the dampening fluid layer formed on the surface of the imaging member at S2007. The patterning may include laser imaging the applied dampening fluid layer according to digital image data to form a dampening fluid pattern on the surface of the imaging member. The laser imaging may be carried using a laser system that is configured for selectively removing or evaporating portions of the dampening fluid layer according to the digital image data.

Methods may include inking the laser-patterning dampening fluid layer on the surface of the imaging member at S2015 to form an ink image. The ink is configured to self-coalesce on the imaging member surface upon inking. The ink may comprise a dispersed polymer ink having high solid content. Methods may include transferring the ink image to another member or a printable substrate such as paper, metal, plastic, or other printable substrates now known or later developed. During a period of time between the inking at S2015 and the transferring at S2017, inks used in provided methods self-coalesce and are partially coalesced when transferred during the transferring of the ink image at S2017. Also, in an embodiment, during a period of time between the inking at S2015 and the transferring at S2017, additional active rheological conditioning such as heat treatment for evaporation and/or UV treatment by UV laser light exposure is not necessary. S2001, S2007, S2015, and S2015 may be repeated for successive images during a print run. Each image may be different from the preceding and/or subsequent image, and substantially no additional cleaning system or step may be required after desirably efficient transfer of ink at S2017 before the applying at S2001.

It will be appreciated that the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A method for ink-based digital printing, comprising:

applying a uniform layer of dampening fluid to a surface of an imaging member;

laser patterning the dampening fluid layer by selectively removing portions of the dampening fluid according to digital image data; and inking the laser-patterned dampening fluid layer on the imaging member surface with an aqueous heterogeneous ink comprising self-coalescing polymeric nanoparticles that are less than 500 nm in size, optionally swellable with the ink vehicle, to form an ink image, wherein the self-coalescing polymeric nanoparticles in the aqueous heterogeneous ink self-coalesce without active rheological conditioning before the ink is transferred from the imaging member surface, wherein the polymeric nanoparticles are formed from sulfonated polyester polymer resin and wherein the imaging member surface comprises a flourosilicone.

2. The method of claim 1, wherein the aqueous heterogeneous ink comprises between about 30 percent by weight and about 75 percent by weight of a liquid ink vehicle.

3. The method of claim 1, wherein the aqueous heterogeneous ink comprises between 10 percent by weight and 75 percent by weight water content.

4. The method of claim 1, wherein the aqueous heterogeneous ink comprises a polymer or oligomer content between about 10 percent by weight to about 55 percent by weight.

5. The method of claim 1, wherein the wherein the aqueous heterogeneous ink comprises a pigment content between about 5 percent by weight to about 25 percent by weight.

6. The method of claim 1, wherein the aqueous heterogeneous ink at inking temperature has a viscosity between 10 centipoise and 10,000 centipoise wherein the temperature lies in a range of between about 20 degrees Celsius to about 50 degrees Celsius.

7. The method of claim 1, wherein the dampening fluid layer comprises a non-aqueous liquid, wherein the non-aqueous liquid is substantially not miscible with water within the temperature range of about 20 degrees Celsius to about 50 degrees Celsius.

* * * * *